US008251543B2

(12) United States Patent
Bauer

(10) Patent No.: US 8,251,543 B2
(45) Date of Patent: Aug. 28, 2012

(54) INTERIOR CORNER MOUNTING MODULE FOR ROPE LIGHT SYSTEM

(75) Inventor: Joshua G. Bauer, Ames, IA (US)

(73) Assignee: Innovative Lighting, Inc., Roland, IA (US)

( * ) Notice: Subject to any disclaimer, the term of this patent is extended or adjusted under 35 U.S.C. 154(b) by 525 days.

(21) Appl. No.: 12/276,332

(22) Filed: Nov. 22, 2008

(65) Prior Publication Data

US 2010/0127139 A1 May 27, 2010

(51) Int. Cl.
*F21V 21/00* (2006.01)

(52) U.S. Cl. ..... 362/249.11; 362/217.14; 362/145; 248/220.1; 248/66

(58) Field of Classification Search ..... 248/220.1, 248/227.1, 230.1, 230.7, 231.81, 66, 67; 362/249.01, 249.11, 382, 391, 396, 400, 362/145, 147, 150–152, 217.01, 217.14, 362/806; 174/72 A, 48, 101, 68.1
See application file for complete search history.

(56) References Cited

U.S. PATENT DOCUMENTS 1,825,010 A * 9/1931 Murphy ..... 52/288.1
3,789,211 A 1/1974 Kramer
4,600,975 A 7/1986 Roberts
4,639,841 A 1/1987 Salestrom et al.
4,654,766 A 3/1987 Tung
4,720,773 A 1/1988 Ahroni
4,763,232 A 8/1988 Woodside
4,774,646 A 9/1988 L'Heureux
4,777,573 A 10/1988 Liao
4,812,956 A 3/1989 Chen
4,885,664 A 12/1989 Hermanson
4,890,206 A 12/1989 Lee
4,901,212 A 2/1990 Prickett
4,903,179 A 2/1990 Lin
4,941,072 A 7/1990 Yasumoto et al.
4,974,128 A 11/1990 Prickett
4,991,071 A 2/1991 Braasch
4,994,944 A 2/1991 Vernondier
5,018,055 A 5/1991 Wu
5,023,762 A 6/1991 Tieszen
5,027,262 A 6/1991 Freed
5,051,877 A 9/1991 Liao
5,067,061 A 11/1991 Prickett
5,095,250 A 3/1992 Woodside
5,095,413 A 3/1992 Goldberg
5,109,324 A 4/1992 Ahroni
5,110,078 A 5/1992 Gary
5,118,196 A 6/1992 Ault et al.
5,124,903 A 6/1992 Coviello
5,217,298 A 6/1993 Jackson et al.
5,245,519 A 9/1993 Openiano
5,249,107 A 9/1993 Poulsen
5,366,780 A 11/1994 Rapisarda
5,428,518 A 6/1995 Huang
5,446,640 A 8/1995 Lin
5,521,799 A 5/1996 VerKamp
5,577,832 A 11/1996 Lodhie (Continued)

*Primary Examiner* — Tan Le
(74) *Attorney, Agent, or Firm* — Davis Brown Law Firm; Kent A. Herink

(57) ABSTRACT

A mounting module for a rope light system which easily attaches to the surfaces of an interior corner of a structure that can retain and support a rope light without the need of a junction or brake in the rope light by holding the rope light in a flexure curve that does not stress the LEDS or electrical conductors of the rope light.

14 Claims, 7 Drawing Sheets

U.S. PATENT DOCUMENTS 5,594,628 A 1/1997 Reuter et al.
5,607,227 A 3/1997 Yasumoto et al.
5,621,994 A * 4/1997 Cobb et al. ..... 403/73
5,626,419 A 5/1997 Lin
5,628,557 A 5/1997 Huang
5,645,342 A 7/1997 Chang
5,647,660 A 7/1997 Lee
5,662,409 A 9/1997 Huang
5,685,635 A 11/1997 Barthelmess
5,691,596 A 11/1997 Yu
5,700,082 A 12/1997 Peng
5,746,504 A 5/1998 Dodson
5,758,948 A 6/1998 Hale
5,772,311 A 6/1998 Williams et al.
5,791,762 A 8/1998 Wroblewski
5,813,751 A 9/1998 Shaffer
5,823,655 A 10/1998 Brooks
5,823,659 A 10/1998 Klose
5,823,660 A 10/1998 Hsu
5,826,965 A * 10/1998 Lyons ..... 362/249.01
5,860,731 A 1/1999 Martinez
5,964,518 A 10/1999 Shen
5,971,563 A 10/1999 Maggio
5,975,717 A 11/1999 Rahman
5,984,489 A 11/1999 Rubenstein
6,017,131 A 1/2000 Goins
6,033,088 A 3/2000 Contigiani
6,039,458 A 3/2000 Coates et al.
6,050,701 A 4/2000 Stone
6,056,419 A 5/2000 March
6,123,433 A 9/2000 Chen
6,176,600 B1 1/2001 Huang
6,179,440 B1 1/2001 Palmer
6,183,104 B1 2/2001 Ferrara
6,186,644 B1 2/2001 Mosseau
6,203,171 B1 3/2001 Sherman et al.
6,220,742 B1 4/2001 Lloyd et al.
6,224,224 B1 5/2001 Bear
6,224,231 B1 5/2001 Personius
6,224,232 B1 5/2001 Rodriguez
6,231,210 B1 5/2001 Pendergrass
6,250,782 B1 6/2001 Huang
6,265,834 B1 7/2001 Lin
6,283,612 B1 9/2001 Hunter
6,290,372 B1 9/2001 Mack
6,302,562 B1 10/2001 Wu
6,309,086 B1 10/2001 Tomlinson
6,354,714 B1 3/2002 Rhodes
6,364,508 B1 * 4/2002 Moreland ..... 362/241
6,367,953 B1 4/2002 Lee
6,371,637 B1 4/2002 Atchinson et al.
6,382,812 B1 5/2002 Hsu
6,390,645 B1 5/2002 Wu
6,394,623 B1 5/2002 Tsui
6,394,624 B1 5/2002 Hsu
6,402,341 B1 6/2002 Onate
6,422,716 B2 7/2002 Henrici et al.
6,424,096 B1 7/2002 Lowe et al.
6,450,665 B1 9/2002 Cheng
6,461,019 B1 10/2002 Allen
6,478,455 B2 11/2002 Ahroni
6,478,499 B1 * 11/2002 Fugman et al. ..... 403/82
6,485,161 B1 11/2002 Whitaker et al.
6,494,591 B1 12/2002 Guimond
6,497,496 B2 12/2002 Wang
6,497,498 B2 12/2002 Adams
6,502,955 B2 1/2003 Ko
6,505,956 B1 1/2003 Priddy et al.
6,508,572 B2 1/2003 Kumada
6,511,206 B1 1/2003 Fan Wong
6,520,661 B1 2/2003 Hill
6,527,413 B1 3/2003 McIngvale
6,533,437 B1 3/2003 Ahroni
6,561,674 B2 5/2003 Gibboney, Jr.
6,572,238 B1 6/2003 Johnson
6,572,243 B2 6/2003 Liu
6,575,595 B1 6/2003 Wu
6,578,986 B2 6/2003 Swaris et al.
6,582,094 B2 6/2003 Liu
6,595,658 B2 7/2003 Tsai
6,604,841 B2 8/2003 Liu
6,607,284 B1 8/2003 Tsai
6,626,559 B1 9/2003 Lin
6,634,765 B2 10/2003 Lin
6,634,766 B1 10/2003 Gordon
6,641,283 B1 11/2003 Bohler
6,660,935 B2 12/2003 Southard et al.
6,663,259 B2 12/2003 Westfall
6,685,340 B2 2/2004 Symonds
6,688,754 B1 2/2004 Wu
6,690,120 B2 2/2004 Oskorep et al.
6,776,504 B2 8/2004 Sloan et al.
6,787,990 B2 9/2004 Cok
6,789,920 B2 9/2004 Liou
6,796,680 B1 * 9/2004 Showers et al. ..... 362/246
6,802,630 B2 10/2004 Doppelt
6,811,283 B1 11/2004 Kovacs
6,846,093 B2 1/2005 Swaris et al.
6,851,831 B2 2/2005 Karlicek, Jr.
6,866,394 B1 3/2005 Hutchins et al.
6,876,149 B2 4/2005 Miyashita
6,939,029 B1 9/2005 Stahel et al.
6,942,360 B2 9/2005 Chou et al.
6,942,361 B1 9/2005 Kishimura et al.
6,946,805 B2 9/2005 Segan et al.
6,967,791 B2 11/2005 Schmidtke et al.
6,969,179 B2 11/2005 Sloan et al.
6,971,768 B1 12/2005 Pepito et al.
6,972,528 B2 12/2005 Shao
6,997,577 B1 2/2006 Pepito et al.
7,001,062 B2 2/2006 Lin
7,014,331 B2 3/2006 Risch et al.
7,018,067 B2 3/2006 Wu
7,021,792 B2 4/2006 Lin
7,048,413 B2 5/2006 Fan
7,063,442 B2 6/2006 Sugar
7,066,636 B2 6/2006 Wu
7,102,301 B2 9/2006 Oskorep et al.
7,118,249 B2 10/2006 Hsu et al.
7,152,999 B2 12/2006 Lin
7,159,998 B2 * 1/2007 Moreland ..... 362/249.01
7,178,941 B2 2/2007 Roberge et al.
7,182,503 B1 2/2007 Lin
7,186,000 B2 3/2007 Lebens et al.
7,192,168 B2 3/2007 Day
7,229,187 B2 6/2007 Packard et al.
7,234,838 B2 6/2007 Sloan et al.
7,234,839 B2 6/2007 Cheng
7,264,374 B1 9/2007 Spika
7,313,880 B2 * 1/2008 Yamagishi ..... 40/782
7,334,921 B1 2/2008 Simnor
7,344,265 B1 3/2008 Tieken
7,347,606 B1 3/2008 Patten
7,375,280 B2 * 5/2008 VanderVelde et al. ..... 174/72 A
7,377,669 B2 5/2008 Farmer et al.
7,377,802 B2 5/2008 Allen
7,419,277 B2 9/2008 Von Ronn et al.
7,798,668 B2 * 9/2010 Cunius ..... 362/133

* cited by examiner

INTERIOR CORNER MOUNTING MODULE FOR ROPE LIGHT SYSTEM

FIELD OF THE INVENTION

The present invention relates to a mounting device for a continuous rope light intended to extend over an interior corner of a structure. The mount would be part of a system for mounting a continuous or a contiguous series of rope lights onto a plurality of topological surfaces such as a building exterior.

BACKGROUND

The external ornamentation of a structure such as a house or a building is well known in the industry especially for the purposes of holiday lighting and/or advertising indicia. Initially strings of incandescent lights were used that required no more than simple hooks to mount them to a structure. The next evolution of exterior structure lighting employed series of light emitting diodes (LEDs) and their supporting electrical conductors enveloped within a flexible, translucent plastic tube which were to become known as a rope lights. These early rope lights were produced in lengths limited to the manufacturing limitations of the external tube and the process for drawing the LED arrays into the tube.

The current state of the art in rope lights utilizes LEDs and their conductors extruded within a continuous medium of flexible, translucent plastic. Enveloping the lights and conductors within the plastic medium guaranteed efficient orientation of the LEDs for best light output and protected the lights and conductors from the effects of weather. This extruded configuration increased the practical length of the rope light greatly as the power utilization of the LEDs became the new limiting factor. Since the nature of LEDs is power efficiency, the maximum length of the rope light has increased dramatically. A new limiting factor introduced with the extruded rope light is the amount the rope light can bend before stressing or breaking the internal components in the extrusion.

When mounting a rope light to a structure it is advantageous to have as few breaks between continuous lengths of rope lights to minimize the possibility of breaks and exposure of the rope light circuitry. Systems of mounting modules have been created to conform a rope light to the external topography of structures but when encountering a significant angular redirection most systems require a junction module that necessitates a break in the rope light. This is most obvious when it comes to interior corners as most mounting systems are designed to be in direct contact with the surface of the structure.

Therefore what is needed is a mounting device that would function as module in a structural rope light mounting system, for a continuous rope light that can extend over an interior corner of a pair of adjoining surfaces without requiring a break in the rope light. The device should; aesthetically match with the other modules in the system, retain the rope light at a flexure curve that will not stress the rope light's internal components, be easily installable and able to be efficiently mass produced.

SUMMARY OF THE INVENTION

To meet these needs, the present invention generally provides a mounting module for a continuous rope light that is compatible with other mounting modules configured in a structural rope light system. The rope light mounting module is designed to attach to a structure in an interior corner without interrupting the rope light by a break in the extrusion or integrated electrical conductors. The module would hold the rope light at a flexure curve that assures an amount of stress non-detrimental to the internal conductors, light emitting diodes or other integrated components of the rope light.

In one aspect of the invention, the rope light mounting module would include structural elements such as holes, slots or indents for fixing the mounting module to the structure with fasteners such as screws, nails, staples or the like. The structural elements may be placed in a location where the fasteners would be occluded by the installation of the rope light.

In another aspect of the invention, the rope light mounting module would include connection elements such as a set of mated extensions and cavities to connect the ends of the interior corner module to other modules of the rope light mounting system. The connection elements would connect to each other in a seemingly seamless manner to enhance the aesthetic flow of the system.

In another aspect of the invention, a rope light mounting module is manufactured as a two piece construct with each of the two pieces being identical to each other. Such a design configuration would allow ease of manufacturing, assembly and parts maintenance.

A significant benefit provided by the present invention is that the interior corner mount would allow the mounting of a continuous rope light across an interior corner without the need of interruption to the rope light itself. Other advantages include an uninterrupted aesthetic to the rope light mounting system, ease of installation and efficiency of manufacture.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DESCRIPTION OF THE DRAWINGS

The invention will be better understood and objects of the invention will become apparent when consideration is given to the following detailed description thereof. Such description makes reference to the annexed drawings wherein.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in detail sufficient to enable those skilled in the art to practice the invention, and it is to be understood that other embodiments may be utilized and that structural, logical and mechanical changes may be made without departing from the spirit and scope of the present invention. The following detailed description is, therefore, not to be taken in a limiting sense, and the scope of the present invention is defined by the appended claims.

Figure 1:
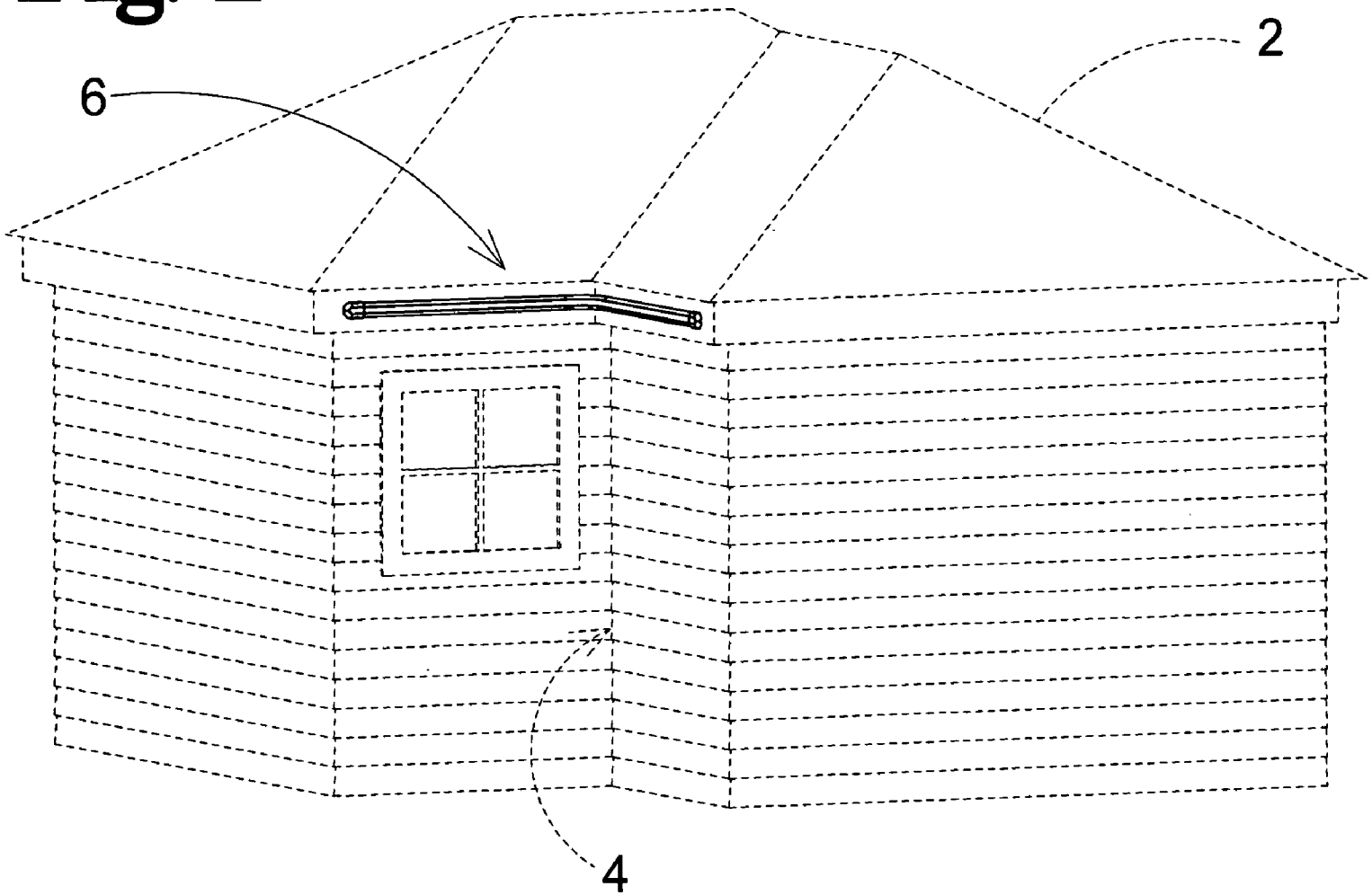
FIG. 1 is an exterior view of a structure with an interior angle to which a rope light system is attached

FIG. 1 depicts a structure (2) or building such as a house that includes and interior corner (4) or a pair of surfaces adjoined at an acute or obtuse angle. On the edge of the roof is depicted a rope light system (6) that is mounted along an interior corner (4) section of the roof's perimeter.

Figure 2:
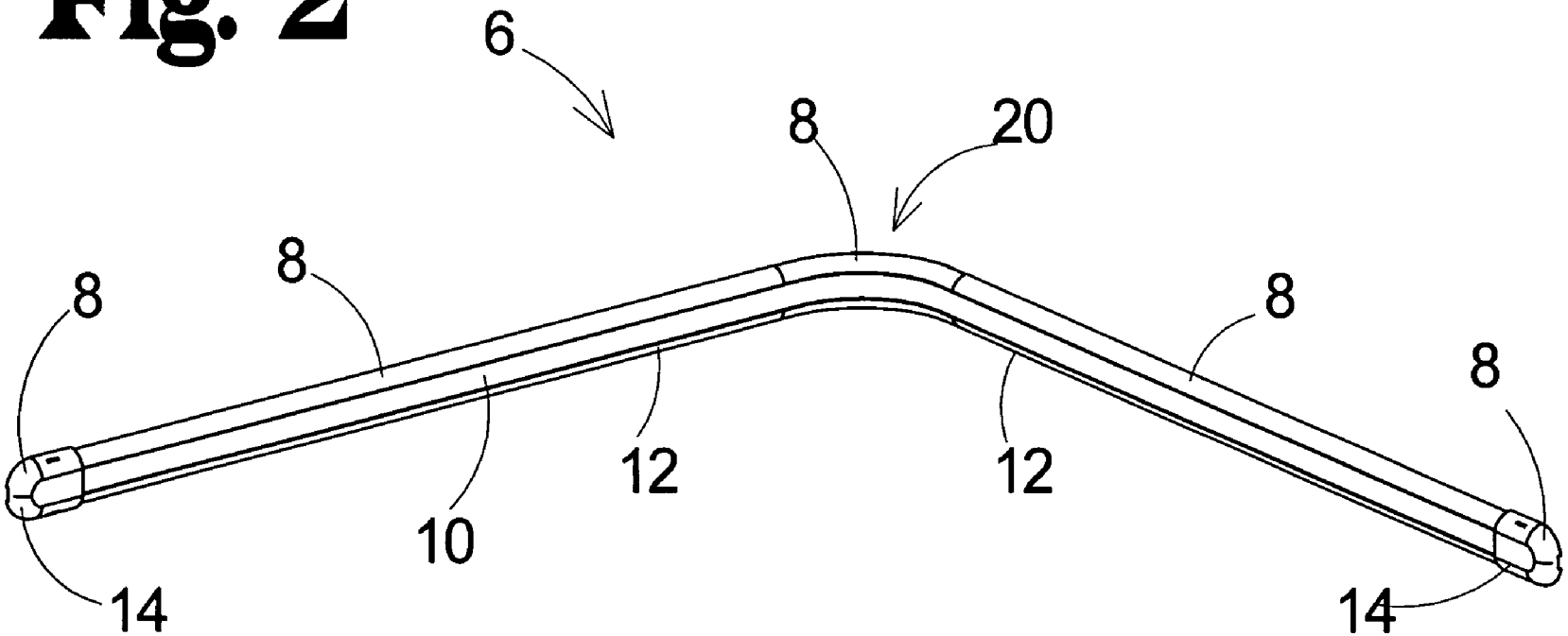
FIG. 2 is an upper perspective view of one embodiment of a rope light system illustrating the invention combined with other elements of the system.

FIG. 2 is a close-up view of the rope light system (6) depicted in FIG. 1. The system is comprised of five mounting modules (8) and a rope light (10). The specific modules, listing from left to right, include; an end cap (14), a linear rail (12), an interior corner mount module (20), another linear rail (12), and another end cap (14). It is anticipated that a rope light systems (6) utilizing many more parts, such as angled junctions, exterior corner mount modules, curved rails, angled rails, multi junctions, etc. could be configured, but for the purpose of specifying the present invention the simple rope light system (6) is sufficient for example.

Figure 3:
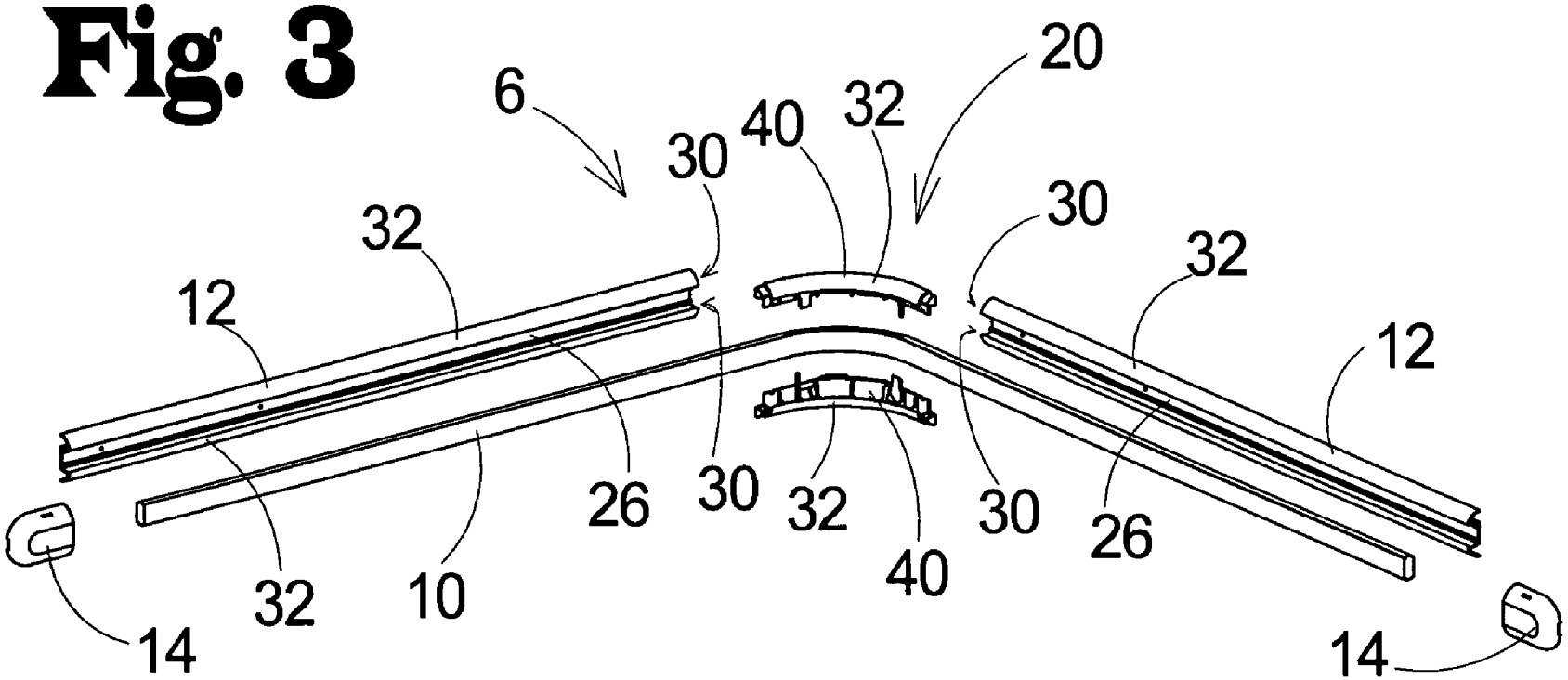
FIG. 3 is an exploded view of FIG. 2 showing the constituent elements of this embodiment of a rope light system.

FIG. 3 is an exploded view of FIG. 2 demonstrating the constituent parts of the rope light system (6). The rope light (10) is retained within a channel (26) that is integral to all of the mounting modules (4). Each mounting module also includes a rail face (32) or outer decorative molding that gives the rope light system (6) a clean and continuous look. The linear rails (12) include a pair of receiving cavities (30) within the rail faces (32) at each end designed to engage a coupling extension (28) from the adjacent mounting module (8). The embodiment specific to FIG. 3 depicts that the interior corner mount module (20) consists of a pair of twin sections (40) forming a lower and upper half divided along the longitudinal axis.

Figure 4:
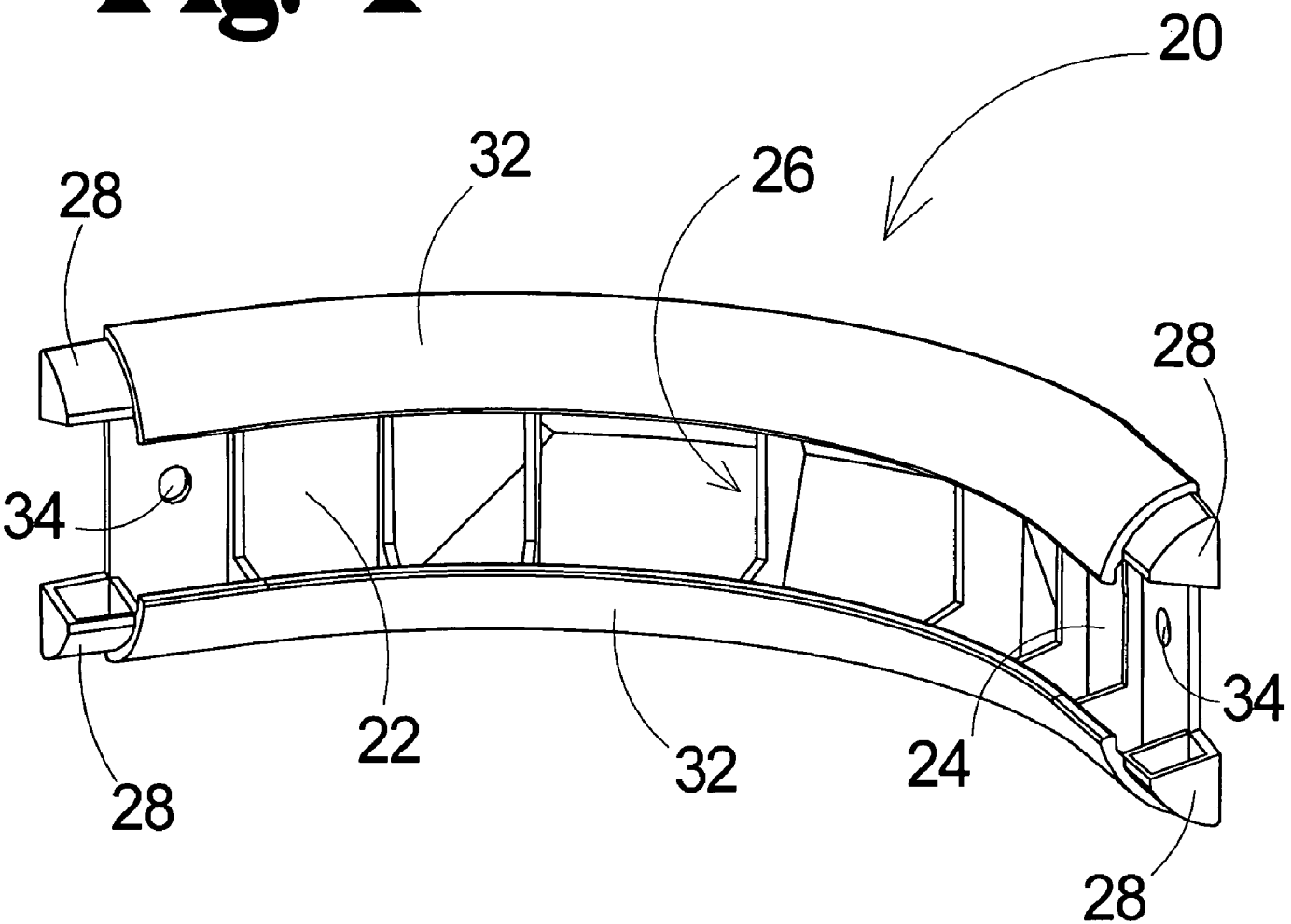
FIG. 4 is an enlarged perspective view of one embodiment of an interior corner mount module.

FIG. 4 shows the interior corner mount module (20) as a single piece. Both ends include a pair of coupling extensions (28) extending beyond the rail faces (32) for engaging with receiving cavities (30) formed within the rail faces (32) of its complimentary mounting modules (8) but the invention is not so limited. In alternate embodiments a pair of coupling extensions (28) may only exist on a first end having a pair of receiving cavities (30) at the second end. Likewise each end may include one coupling extension (28) and one receiving cavity (30) that would compliment any end-to-end connection. The coupling extension (28) comprises any extension of the interior corner mount module (20) that would be designed to fit or nest within the receiving cavity (30) of a complimentary mounting module (8). Such coupling extensions (28) may include any shape that would adequately fit into a corresponding receiving cavity (30). The coupling extensions (28) and receiving cavities (30) may be designed to engage each other in a mechanical engagement, tension attachment or merely align the connecting modules together to form a continuous aesthetic look with no means for fixture.

Figure 7:
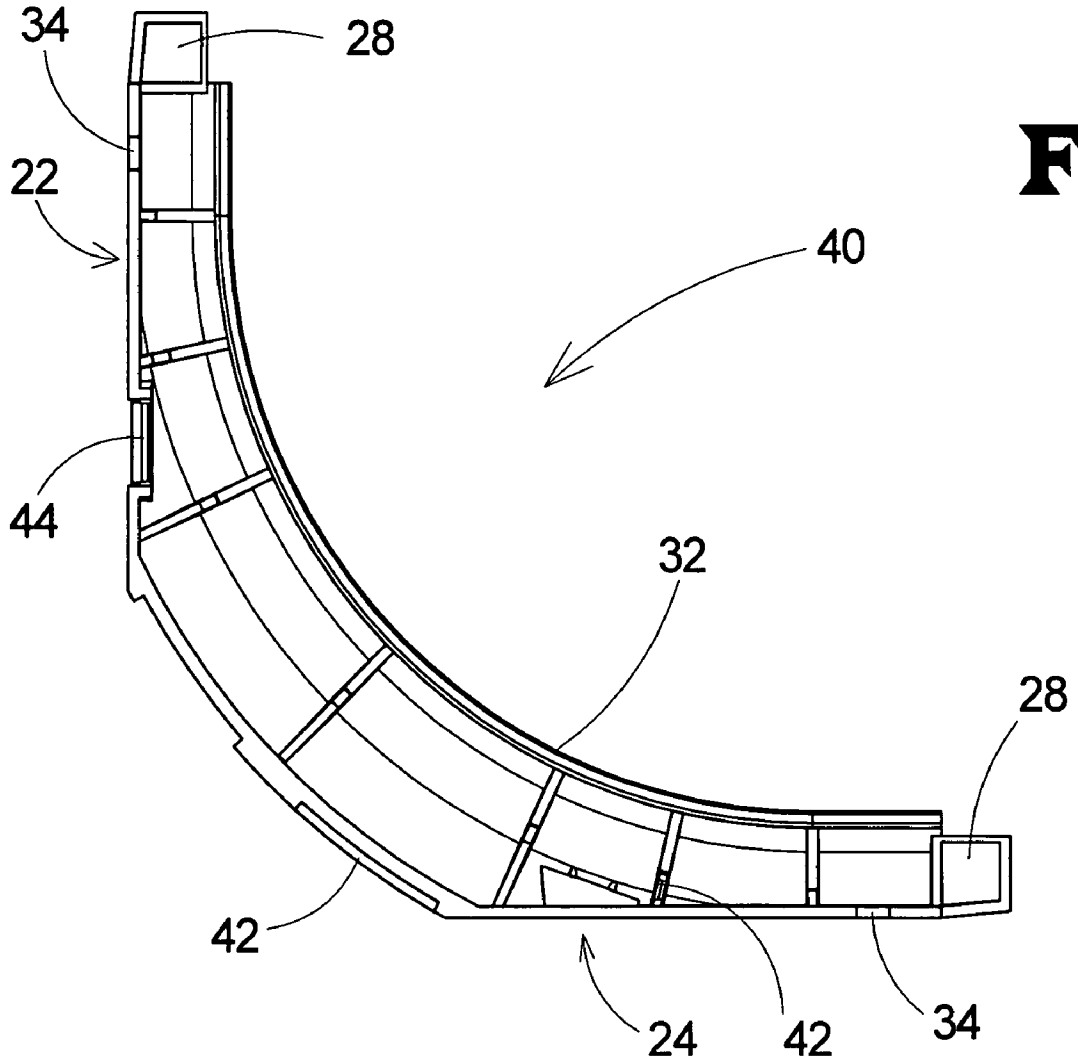
FIG. 7 is a plan view of a single twin section of the interior corner mount module.

The configuration of the interior corner mount module (20) includes a pair of surfaces that are designed to match the angle of the interior corner (4) of the structure (2). The first matching surface (22) would conform to a first surface of the interior corner (4) of the structure (2) and the second matching surface (24) would conform to the second surface of the interior corner (4) of the structure. In the illustration of FIG. 4 the surfaces are aligned at a ninety degree angle to one another but the invention is not so limited. It is anticipated that a variety of interior corner (4) angles, both acute and obtuse, could be matched by alternate designs of the interior corner mount module (20). FIG. 7 best illustrates the relation of the first and second matching surfaces (22 & 24) to the interior corner mount module (20). In FIG. 4 these surfaces are located generally near the ends of the interior corner mount module (20) and include the fastener accommodations (34) for attaching each end of the interior corner mount module (20) one to each of the adjoining surfaces of the interior corner (4) of the structure (2).

The embodiment illustrated in FIG. 4 includes a matched or mirrored pair of decorative rail faces (32), one to each side of the channel (26). The rail face (32) is similar to molding which forms a decorative faqade intended to blend the look of the rope light system (6) apparatus into the aesthetic look of the structure's (2) exterior. Although a matched pair of rail faces (32) are shown in the exemplary Fig.s the invention is not so limited. It is anticipated that depending on the design of the rope light (10) the top and bottom rail faces (32) may be substantially dissimilar in size, cross-sectional shape, texture and/or angle. For example, the rail faces (32) of an alternative design may resemble crown molding, consist of a simple abutment or include a texture to match a complimentary style such as a pattern copied from wall paper.

The interior corner mount module (20) includes a channel (26) designed to receive and retain a rope light (10). The channel may include continuous well and wall surfaces or as depicted in the figures consist of a series structural ribs, all with channel forming cut-outs. The rope light (10) in the illustrated embodiment has a generally rectangular cross section that is retained within the channel (26) by a pair of overlapping lips formed by the end perimeter of the rail faces (32) forming the edges of the channel (26). In other embodiments the rope light (10) may have a different cross section to which the channel (26) would conform to retain the rope light (10) in a nested fit.

The interior corner mount module (20) is curved along its length conforming to a safe amount of flexure for the rope light (10). This amount of curve is calculated to assure the integrity of the constituent functional elements within the rope light (10) which may be damaged from flexing the rope light (10) too aggressively. Illustrated in the in FIGS. 1 through 7 are modules designed for a rectangular cross section rope light (10) with specific characteristics. It is anticipated that when employing a flatter, or more robust rope light (10) that the flexure angle could be more severe or if employing a thicker, or more delicate rope light (10) the flexure angle would be less severe. The measure of the flexure angle would be dependant of the specific characteristics of the rope light (10). The advantage provided by the curvature is that by holding the rope light (5) in such a manner allows the negotiation of an interior corner (4) without the need of a junction or break in the rope light (10).

The interior corner mount module (20) includes a number of fastener accommodations (34) for attaching it to the structure (2). In FIG. 4 the fastener accommodations (34) are in the form of holes, through which a screw (not shown) would be passed through and engaged to the structure (2) until the head of the screw could bias the interior corner mount module (20) against the structure (2) in a fixed yet removable manner. Similarly the same fastener accommodation (34) may employ a nail (not shown) to fix the interior corner mount module (20) to the structure. It is anticipated that a variety of fasteners may be used to attach the interior corner mount module (20) to the structure (2) including; staples, rivets, tension bolts, expansion bolts, twist locks, clasps, hooks, and etcetera wherein the shape and structure of the fastener accommodation (34) would be readily adapted by those skilled in the art to conform to the individual characteristics of the specific fastener. When assembled the installation of the rope light (10) would occlude the fastener accommodation (34) and fastener from view.

Figure 5:
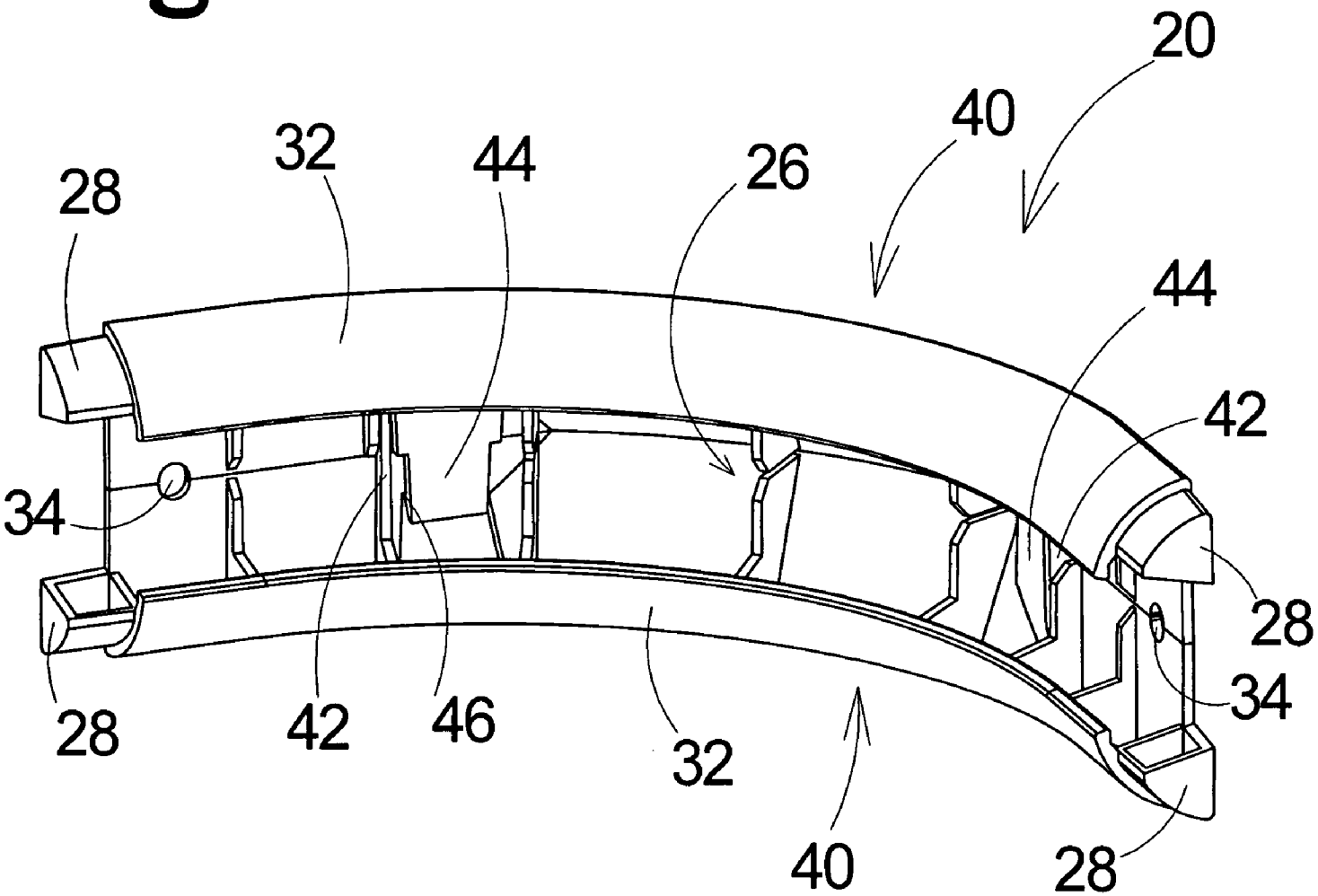
FIG. 5 is an enlarged perspective view of another embodiment of an interior corner mount module utilizing twin sections.
Figure 6:
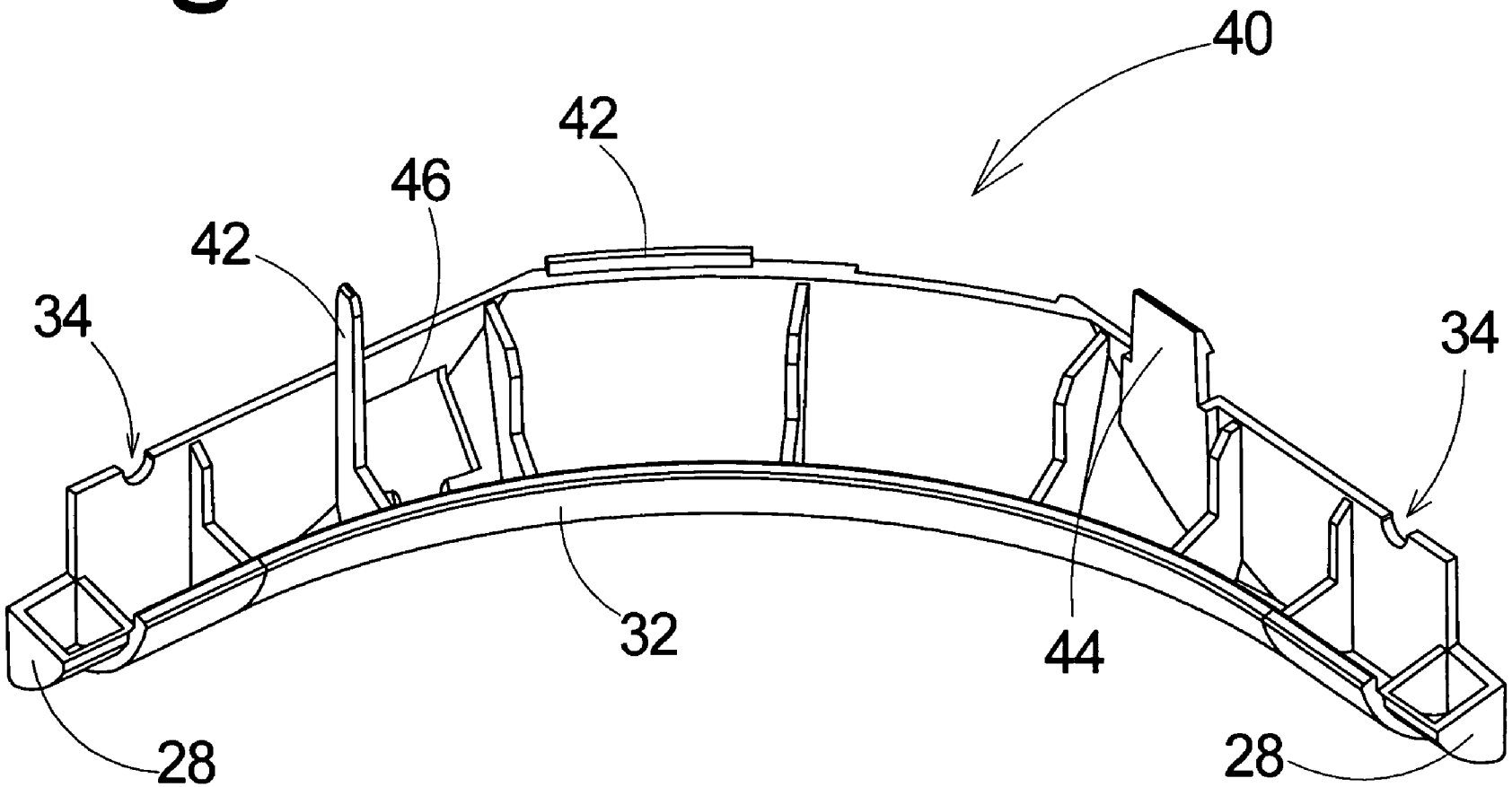
FIG. 6 is an enlarged perspective view of one twin section of the interior corner mount module of FIG. 5.

FIG. 5 illustrates an embodiment of the interior corner mount module (20) which consists of two twin sections (40) that when connected to each other form an alternative embodiment of an interior corner mount module (20') similar to the embodiment depicted in FIG. 4. The twin sections (40) are identical to each other and use a number of symmetrically and complimentarily placed alignment guides (42), tension tabs (44) and catches (46) to connect to each other. The fastener accommodations (34) in the twin section (40) embodiment, take the form of complimentary detents, which, when connected together, form a hole. Similarly the tension tab (44) mounted on one side complimentarily link with the catch (46) on the opposite side to form a means for interlocking the twin sections (40) together. The catch (46) in this embodiment is merely an opening designed to engage the hook end of the tension tab (44). That same opening also allows one to displace the proximal end of the tension tab (44) to disengage it from the catch (46) for disassembly. Alignment guides (42) may include any element that helps guide the individual twin sections (40) into proper alignment for engaging one another. In FIG. 5, one alignment guide (42) is an extension of one of the ribs forming the channel (26) which slides between and the edge of the tension tab (44) and another channel forming rib. FIG. 6 illustrates a second alignment guide (42) taking the form of an extending ridge on the back of the interior corner mount module (20) which engages with a complimentary cavity formed in the symmetrically opposite side.

FIG. 6 represents a single twin section (40) illustrating the unengaged tension tab (44) and catch (46) as well as a pair of alignment guides (42).

FIG. 7 represents a top view of one of the twin sections (40) showing the angular relation of the first matching surface (22) and the second matching surface (24) to the overall shape of the interior corner mount module (20).

It should be appreciated from the foregoing description and the many variations and options disclosed that, except when mutually exclusive, the features of the various embodiments described herein may be combined with features of other embodiments as desired while remaining within the intended scope of the disclosure.

It is to be understood that the above description is intended to be illustrative, and not restrictive. Many other embodiments and combinations of elements will be apparent to those skilled in the art upon reviewing the above description and accompanying drawings. The scope of the invention should, therefore, be determined with reference to the appended claims, along with the full scope of equivalents to which such claims are entitled.

What is claimed is:

1. A corner mount module conforming to an interior corner between two intersecting walls of a structure, comprising:

a pair of matching curvilinear surfaces conforming to the angles of the interior corner;

a channel extending the length of said interior corner mount module having a first arm extending along a first of the walls and a second arm extending along a second of the walls, said channel being open to the side opposite the walls;

a rail face extending the length of said interior corner mount module;

a light source retained in said channel by said rail face whereby light emanates through said open channel; and a fastener accommodation located in a matching surface.

2. The interior corner mount module of claim 1, wherein a pair of rail faces are included, one on each side of said channel.

3. The interior corner mount module of claim 2, wherein the pair of rail faces are symmetrically similar.

4. The interior corner mount module of claim 2, wherein the pair of rail faces are symmetrically dissimilar.

5. The interior corner mount module of claim 1, further comprising a coupling extension attached to one of the proximal end of said rail faces.

6. The interior corner mount module of claim 1, further comprising a receiving cavity attached to one of the proximal ends of said rail faces.

7. The interior corner mount module of claim 1, wherein the pair of conforming angles constitutes a substantially ninety degree angle.

8. The interior corner mount module of claim 1, wherein the light source comprises a rope light.

9. The interior corner mount module of claim 8, wherein the fastener accommodations are substantially occluded by the rope light.

10. The interior corner mount module of claim 1, wherein the fastener accommodation comprises a hole.

11. The interior corner mount module of claim 1, wherein the interior corner mount module is comprised by a pair of twin sections.

12. The interior corner mount module of claim 11, wherein the twin sections are identical.

13. The twin section of claim 12, further comprising an alignment guide.

14. The twin section of claim 12, further comprising a tension tab and catch.

* * * * *